United States Patent [19]

Luray

[11] Patent Number: 4,606,460

[45] Date of Patent: Aug. 19, 1986

[54] PROTECTIVE PACKAGES

[76] Inventor: Howard L. Luray, 15730 Beach Dr. NE., Seattle, Wash. 98155

[21] Appl. No.: 547,818

[22] Filed: Nov. 1, 1983

Related U.S. Application Data

[63] Continuation-in-part of Ser. No. 351,042, Feb. 22, 1982, abandoned.

[51] Int. Cl.[4] ..... B65D 81/02

[52] U.S. Cl. ..... 206/583

[58] Field of Search ..... 206/583, 420

[56] References Cited

U.S. PATENT DOCUMENTS

| | | | |
|---|---|---|---|
| 2,501,570 | 3/1950 | Larsen | 206/46 |
| 2,596,244 | 5/1952 | Jacket | 206/583 |
| 2,811,246 | 10/1957 | Sloane | 206/583 |
| 2,837,208 | 6/1958 | Lingonfelter | 206/583 |
| 2,956,672 | 10/1960 | Kirkpatrick | 206/46 |
| 3,136,413 | 6/1964 | Hall | 206/583 |
| 3,463,309 | 8/1969 | Szostek | 206/470 |
| 3,552,595 | 1/1971 | Gerner et al. | 206/583 |
| 3,692,264 | 9/1972 | Burkhard et al. | 206/583 |
| 3,752,301 | 8/1973 | Bluemel | 206/583 |
| 3,853,220 | 12/1974 | Luray | 206/466 |
| 3,857,487 | 12/1974 | Misslin | 206/470 |
| 3,876,812 | 4/1975 | Peters | 206/583 |
| 4,319,684 | 3/1982 | Backman et al. | 206/470 |

FOREIGN PATENT DOCUMENTS 237322 7/1925 United Kingdom .

*Primary Examiner*—Joseph Man-Fu Moy

*Attorney, Agent, or Firm*—Ward Brown; Robert W. Beach

[57] ABSTRACT

A fragile article is enclosed in the central portion of an elongated shock-absorbing cradle supported only at its ends by connection or attachment to the ends of an outer rigid box or framework. The opposite sides of the cradle extend along but are spaced inward of the sides of the box or framework to allow shock-absorbing flexing of the cradle if the box or framework is jolted or jostled during shipment or handling. The cradle can be formed of substantially rigid plastic material and have integral shock-absorbing corrugations, or it can be a sheet or tube of flexible material having its opposite end portions secured to the opposite ends of the box or framework. A box used in the invention can have telescoping base and lid sections, or it can be of one piece construction being formed from a foldable flat paperboard or cardboard blank.

2 Claims, 33 Drawing Figures

Fig. 6.
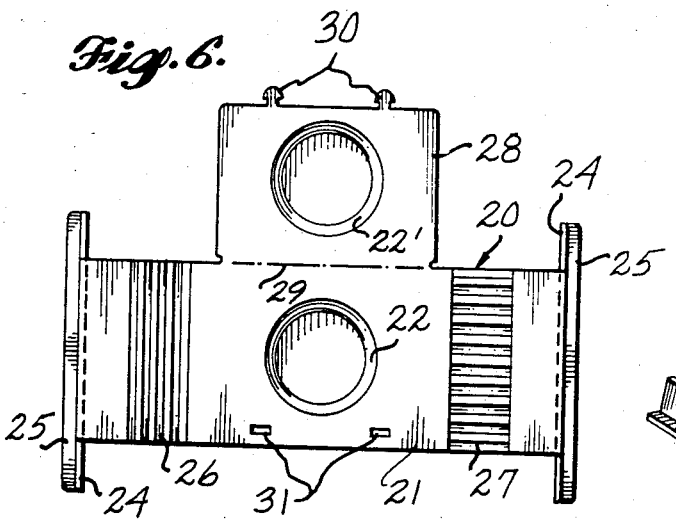
Fig. 7.
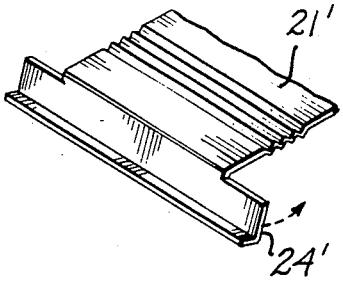
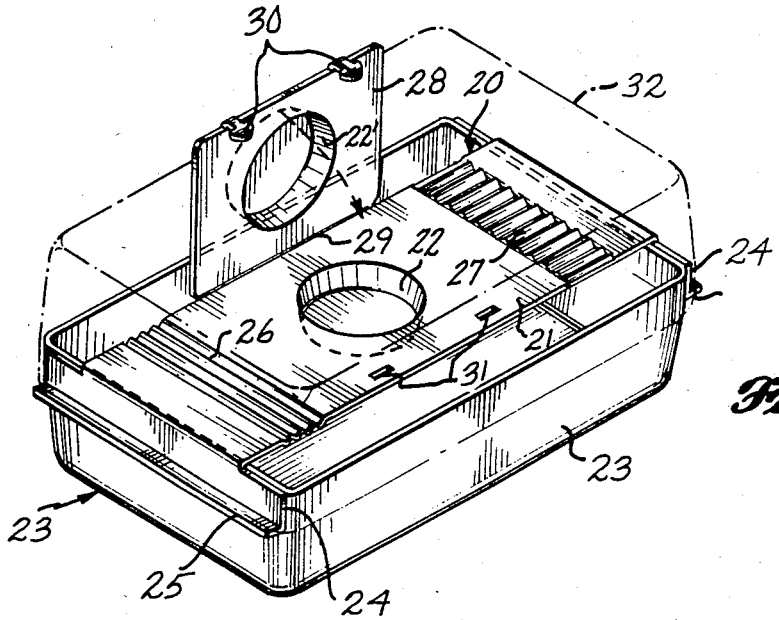
Fig. 5.

32'
57
59
62
56
55
58
56
56
57
59
62
51
58
56
50
53
54
52
60
61
23'
60
61

32'
57
60
58
56
55
63
61
59
50
62
23'

54
55
50
52
54

65'
80'
75'
78'
74'
83'
67'
84'
70'
66'
90
71
69'
82'
91
81
93

112

113

111
109
110
109
105
108

30
111
109
106
105
107
108
107
110
109
106
106
105
109
107
107
109
106
108
30

PROTECTIVE PACKAGES

CROSS-REFERENCE

This application is a continuation-in-part of my earlier application Ser. No. 351,042, filed Feb. 22, 1982, on Protective Packages, abandoned as of the filing date accorded this application.

BACKGROUND OF THE INVENTION

1. Field of the Invention

The present invention relates to special packaging for a fragile article and, more specifically, to the general type of package which includes an outer box and a hammock or cradle extending inside the box and supporting the fragile article.

2. Prior Art

In the package disclosed in Larsen U.S. Pat. No. 2,501,570, a fragile article to be packaged is sandwiched between upper and lower flexible thermoplastic films which have their outer margins heat-sealed or welded together. The margins of the sheets are draped over and are secured to the periphery of the base of a rigid box and the box can be closed by a separate lid. The fragile article is suspended inside the box by the stretched flexible plastic films.

My earlier U.S. Pat. No. 3,853,220 is directed to a package for a fragile article in which the central, article-enclosing portion of a supporting hammock is formed of thin, flexible thermoplastic material, but the opposite ends of the hammock are secured to rigid legs which, in the preferred embodiment, extend over opposite ends of the base of a rigid outer box. As a lid for the box is telescoped over the base, it engages the legs and swings them downward against the sides of the box base to stretch the flexible hammock extending between the upper parts of the legs.

British Pat. No. 237,322 discloses a package for fragile articles in which the article is inserted into a fabric sleeve which has its opposite end portions twisted and secured to the opposite ends of a rigid box base, such as by snugly fitting the twisted fabric ends in slots or apertures in the ends of the box base.

In the packaging disclosed in Kirkpatrick U.S. Pat. No. 2,956,672, a fragile article to be packaged is inserted into a tube of heat-shrinkable material which has its opposite ends attached to the inner upright sides of a box base by clips or clamps.

SUMMARY OF THE INVENTION

It is an object of the present invention to provide a package for a fragile article in which the article is enclosed by a rigid box or box framework and is held out of contact with the box walls, but in a form which does not necessarily require a specially designed package and assembly procedure for each type of fragile article to be packaged.

It also is an object to provide such a package in a form that is simple to use and assemble.

Another object is to provide such a package that can be mass-produced and, preferably, assembled by automatic equipment if many identical articles are to be packaged.

A further object is to provide such a package in a form using a minimum of different components.

An additional object is to provide such a package in a form in which at least some of the package components can be reused.

Still another object is to provide such a package which can be used in attractively displaying the fragile article.

These and other objects are accomplished by the protective packages in accordance with the present invention described in detail below.

BRIEF DESCRIPTION OF THE DRAWINGS

FIG. 5 is a somewhat diagrammatic top perspective of another embodiment of a protective package in accordance with the present invention which also includes an outer rigid box and a shock-absorbing, article-suspending cradle;

FIG. 6 is a top plan of the article-suspending cradle shown in FIG. 5; and FIG. 7 is a fragmentary, top perspective of an end portion of a modified cradle.

DETAILED DESCRIPTION

Figures 1, 2:
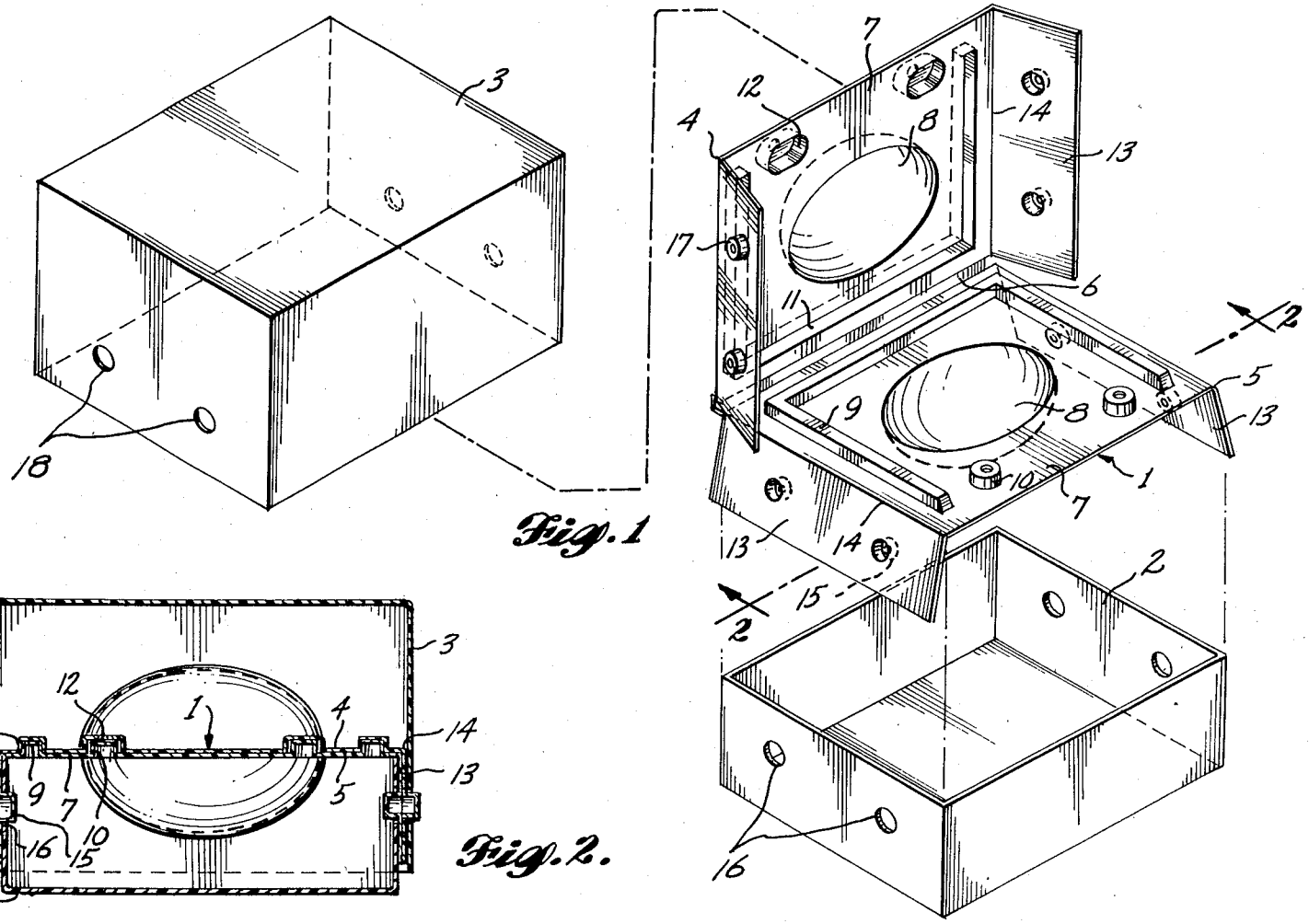
FIG. 1 is a somewhat diagrammatic, exploded, top perspective of a protective package in accordance with the present invention which includes an outer rigid box having telescoping box base and lid components and a shock-absorbing, article-suspending cradle component.
FIG. 2 is a section taken generally along line 2—2 of FIG. 1 but with the package components assembled.

In the embodiment shown in FIGS. 1 and 2, the protective package in accordance with the present invention includes an elongated shock-absorbing cradle 1 for holding a fragile article to be packaged. The cradle extends between opposite ends of the rectangular base 2 of a rigid box which includes a lid 3 that may be telescoped down over the box base. The fragile article held by the cradle is maintained out of contact with the walls of the outer rigid box, and the shock-absorbing characteristics of the cradle prevent damage to the article as the box is jolted or jostled during shipping or handling.

In the form shown in FIGS. 1 and 2, the cradle 1 has separate top and bottom sections 4 and 5 which, as shown in FIG. 1, may be molded integral with each other with a thinner or more flexible section of material forming a hinge joint 6 between them. Each section includes a generally planar central portion 7 having an opening in the form of a cavity 8 which, when the top section 4 is folded over onto the bottom section 5, registers with the cavity in the other section. The registered cavities can be shaped complementally to the exterior of the fragile article to be packaged. After the fragile article to be packaged has been fitted in the cavity 8 of the bottom cradle section 5, the top section 4 is folded over the bottom section so as to substantially enclose the fragile article.

As best seen in FIG. 2, for securing the cradle sections together the bottom section 5 can have an upward-projecting U-shaped rib or ridge 9 including legs at opposite sides of the cavity 8 and buttons 10 at the opposite side of the cavity from the web of ridge 9. Ridge 9 and buttons 10 are snugly fitable, respectively, in a corresponding channel 11 and apertures or cavities 12 when the top cradle section 4 is folded over onto the bottom cradle section 5 for essentially a snap-fit connection between such two sections. Flat legs 13 are formed integral with the central portion 7 of both the top cradle section 4 and the bottom cradle section 5. The legs are bendable along integral fold lines or hinge joints 14 so as to project prependicularly downward from the opposite ends of the two cradle sections, with the inner surfaces of the legs of the top section in substantially contiguous engagement with the outer surfaces of the legs of the bottom cradle section.

The assembled article-enclosing cradle is fitted over the box base 2 with the cradle legs 13 extending downward along the opposite ends, respectively, of the box base. For securing the cradle in position, buttons 15 projecting inward from the legs 13 of the bottom cradle section 5 fit into apertures 16 through the upright ends of the box base. Then the open bottom of the box lid 3 is fitted downward over the box base and the cradle legs 13 to the position shown in FIG. 2. To secure the lid in position, buttons 17 projecting outward from the legs 13 of the top cradle section 4 fit through apertures 18 in the upright ends of the box lid.

Although substantially rigid material, such as polyvinyl chloride thermoplastic material, the cradle has some inherent resiliency and flexibility so as to absorb shocks to which the package may be submitted during shipment or handling. The shock-absorbing characteristics of the cradle are increased because it is supported only at its opposite ends, the longitudinal edges of the cradle extending along but preferably being spaced inward at least slightly from the longitudinal walls of the box. The box also can be formed of thermoplastic material having sufficient flexibility or resiliency so that the ends of the lid can be stretched apart slightly as the box lid is telescoped downward over the cradle legs 13 as the buttons 17 are received in the lid apertures 18.

For an attractive display package, the cradle and the box both can be formed of transparent plastic material. Alternatively, the cradle can be substantially transparent material and the box can be opaque, such as opaque plastic or paperboard, with a viewing window or opening in the top of the box lid and/or the bottom of the box base. Another alternative is for the protective package to be used only for shipment of the fragile articles, in which case it can be reused for shipping the same or similarly shaped or sized articles.

Figure 3:
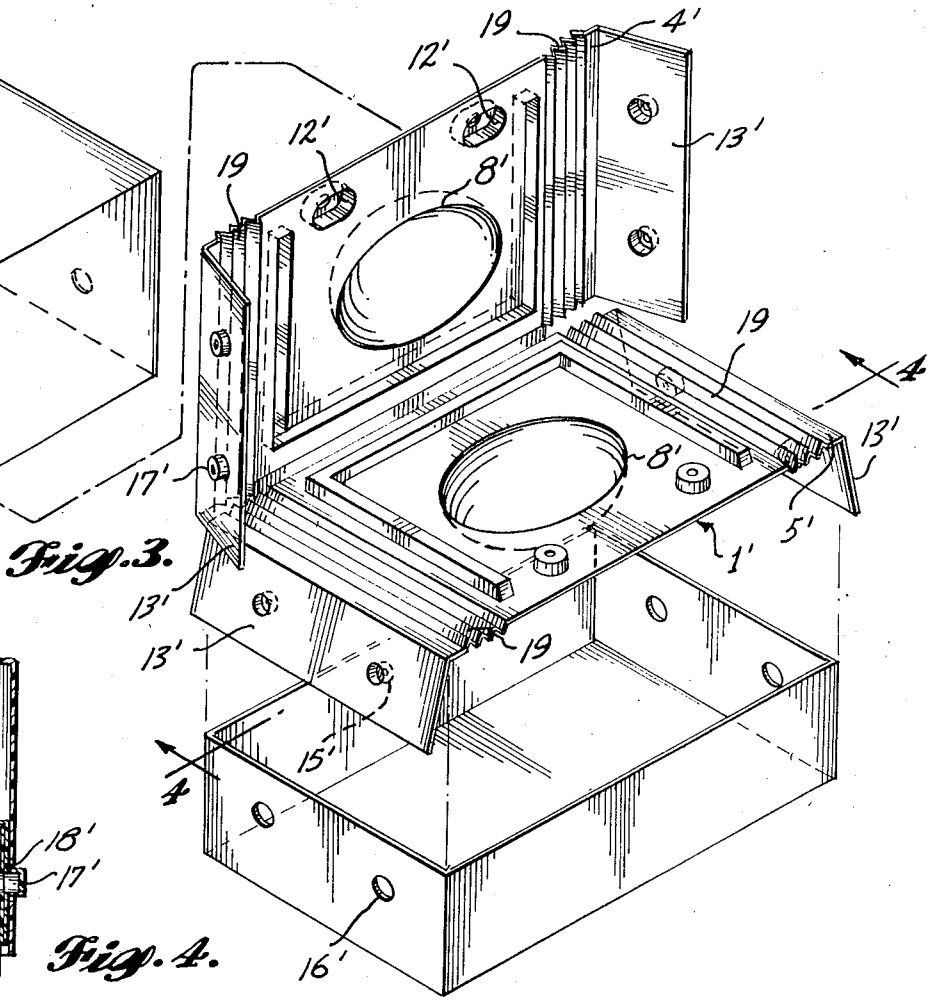
FIG. 3 is a somewhat diagrammatic, exploded, top perspective of a modified form of the protective package of FIG. 1.
Figure 4:
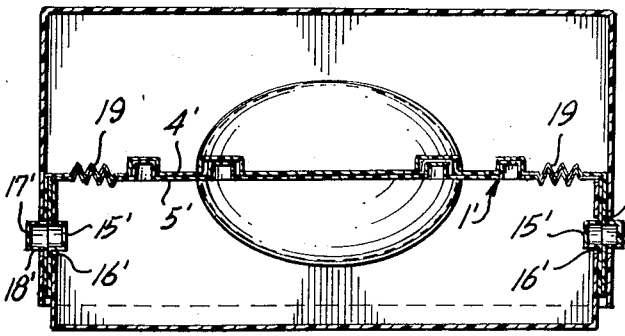
FIG. 4 is a section taken generally along line 4—4 of FIG. 3 but with the package components assembled.

The embodiment of the present invention shown in FIGS. 3 and 4 is very similar to the embodiment shown in FIGS. 1 and 2. In the case of the embodiment shown in FIGS. 3 and 4, however, the shock-absorbing characteristics of the modified cradle 1′ are increased by forming transversely extending strips 19 of shock-absorbing corrugations in both the top and bottom cradle sections. Such strips of corrugations are disposed toward the opposite ends of each such section, respectively, and each of the four strips of corrugations is located between the adjacent cradle leg 13′ and the adjacent side of the corresponding article cavity 8′. In the form shown in FIGS. 3 and 4, the corrugations extend transversely or widthwise of the cradle to promote resilient up and down flexing of the cradle, longitudinal or endwise flexing of the cradle and, to a lesser degree, transverse or widthwise flexing of the cradle. As best seen in FIG. 4 with the top cradle section 4′ folded over the bottom cradle section 5' preferably each corrugation registers with a corrugation of the other cradle section.

In other respects, the construction of the embodiment of the present invention shown in FIGS. 3 and 4 is identical to the construction of the embodiment shown in FIGS. 1 and 2. Specifically, with the package assembled as shown in FIG. 4, the longitudinal edges of the cradle are spaced inward from the longitudinal sides of the box lid and base so as not to interfere with the shock-absorbing flexing of the cradle. The positive connection of the cradle to the box base and lid by the interengagement of the buttons 15' and 17' in the box apertures 16' and 18' assures that the cradle cannot slide relative to the box so as to abruptly engage a side of the cradle against a wall of the box.

In the embodiment of the present invention shown in FIGS. 5 and 6, the separate cradle 20 of the package still is substantially rigid material, preferably thermoplastic material such as polyvinyl chloride. Such cradle includes a generally planar central portion 21 having the article-containing opening or cavity 22. The length of such central portion is approximately equal to the length of the base 23 of the box with which such cradle is used, but such cradle central portion is substantially narrower than the width of the box.

Legs 24 formed integral with the central cradle portion 21, project perpendicularly downward from its opposite ends and extend widthwise beyond its opposite sides. Stop flanges 25 are formed integral with the legs and project outward from their bottom edge portions.

Also formed integral with the central portion of the cradle are transversely extending strips 26 and 27 of shock-absorbing corrugations disposed toward the opposite ends of the cradle, respectively. The corrugations give additional resilient flexibility to the cradle. Each strip of corrugations allows up-and-down flexing of the cradle, the strip 26 toward one end of the cradle has widthwise extending corrugations promoting endwise or longitudinal flexing of the cradle and the strip 27 toward the other end has endwise or lengthwise extending corrugations promoting widthwise or transverse flexing of the cradle.

The fragile article to be packaged may be secured in the cavity 22 such as by taping or gluing or by a strip of pressure-sensitive adhesive held in the bottom of the cavity. In the embodiment shown in FIGS. 5 and 6, however, the central portion of the cradle is formed with an integral lid or flap section 28 projecting transversely from the remainder of such central portion in the area of the cavity 22 and having an opening or cavity 22' shaped complementally to cavity 22. A thinner or more flexible strip of the thermoplastic material forms a hinge joint 29 intermediate the two cavities. When the flap is folded over about the hinge joint onto the remainder of the cradle central portion, the two cavities are in registration. The flap may be secured in folded over condition to enclose the fragile article within the cavities by integral lock tabs 30 projecting from the free end of the flap and received in slots 31 at corresponding locations of the main cradle portion to provide a snap-fit connection, or the flap may be taped, glued or heat-sealed or welded in folded over condition.

After the fragile article has been secured in the cradle cavity, assembly of the protective package is completed by fitting the cradle legs 24 over the opposite ends of the base 23 of the rigid box and telescoping the box lid 32 downward over the legs into engagement with the stop flanges 25. Since the opposite lateral sides of the central, article-containing portion of the cradle are spaced inward a substantial distance from the adjacent longitudinal walls of the box, substantial room is provided for transverse, shock-absorbing motion of the cradle without it coming into contact with the walls of the box. Also, the legs 24 projecting downward from the cradle extend substantially the full width of the box so that the cradle cannot slide widthwise of the box without the upright sides of the legs engaging the lower portion of the box lid telescoped over them.

In the modification shown in FIG. 7, the length of the cradle central portion 21' is slightly less than the distance between the outer sides of the upright ends of the box (not shown), and the legs 24' are inclined outward slightly from the opposite ends of such shortened cradle central portion. After the lower portions of the legs are fitted over the opposite ends of the box base, the box lid is telescoped downward over them, swinging the legs inward against the ends of the box base in the direction of the arrow in FIG. 7. Accordingly, the central portion of the cradle is placed under slight tension so as to make it somewhat less flexible or floppy. In other respects the modified form of the invention shown in FIG. 7 is identical to the form shown in FIGS. 5 and 6.

In the embodiment of the present invention shown in FIGS. 8 through 11, the outer rigid box is substantially the same as for the form shown in FIG. 5 with the exception that the corners 33 between the side and end walls of the box base 23 and lid 32 are substantially more rounded. Rather than having a central portion substantially narrower than its integral legs, the cradle 34 is of uniform width throughout its length including the legs 35 and stop flanges 36, but still is substantially narrower than the width of the box base 23. With the lid 32 telescoped over the cradle legs 35, transverse sliding of the cradle is prevented by engagement of the opposite upright sides of the legs with the rounded corners of the box lid, so that the outer sides of the cradle still are spaced inward a substantial distance from the inner sides of the rigid box to allow the transverse, shock-absorbing movement of the cradle central portion.

Figure 10:
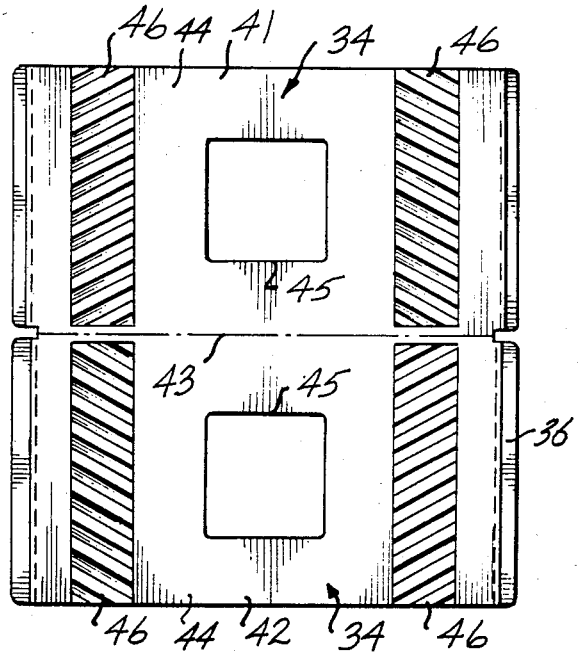
FIG. 10 is a top plan of the supporting portion of such cradle.
Figure 9:
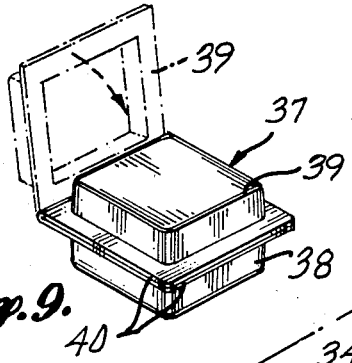
FIG. 9 is a somewhat diagrammatic, top perspective of the article-enclosing portion of such cradle.

In addition, as shown in FIGS. 9 and 10, rather than forming cavities integral with the cradle, in the embodiment of FIGS. 8 through 11 a separate container 37 is provided for the fragile article to be packaged. Such container can be conveniently vacuum formed from thermoplastic sheet material with a base section 38 and lid section 39 hinged together by a thinner joining section of such material. The sections 38 and 39 have complementary cavities for receiving the fragile article. The margins of the lid and base sections form integral support flanges 40 projecting outward from the article-enclosing portions of the lid and base sections and, after such sections have been folded so as to enclose the fragile article to be packaged, the flanges can be glued or heat-sealed or welded together.

Figure 11:
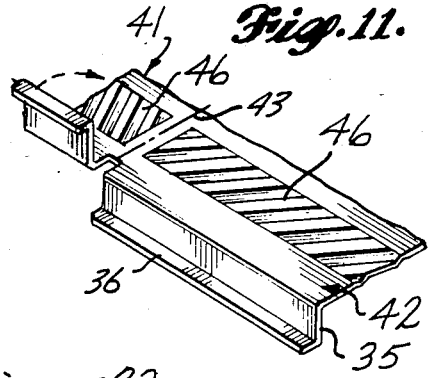
FIG. 11 is a somewhat diagrammatic, fragmentary, top perspective of an end portion of the supporting portion of such cradle.

Similar to the embodiments of FIGS. 1 and 2 and FIGS. 3 and 4, the embodiment of FIGS. 8 through 11 has a double thickness cradle having separate top and bottom portions 41 and 42, respectively, which, as shown in FIG. 10, may be molded integral with each other with a thinner section of material forming a hinge joint 43 between them. Each section includes a generally planar central portion 44 having an opening in the form of an aperture 45 at its center which, when the top section 41 is folded over onto the bottom section 42, registers with the aperture in the other section. As best seen in FIG. 11, initially the integral cradle legs 35 project upward from the top section 41 and downward from the bottom section 42 so that the legs of the upper section will nest over the legs of the lower section as the cradle is folded.

Figure 8:
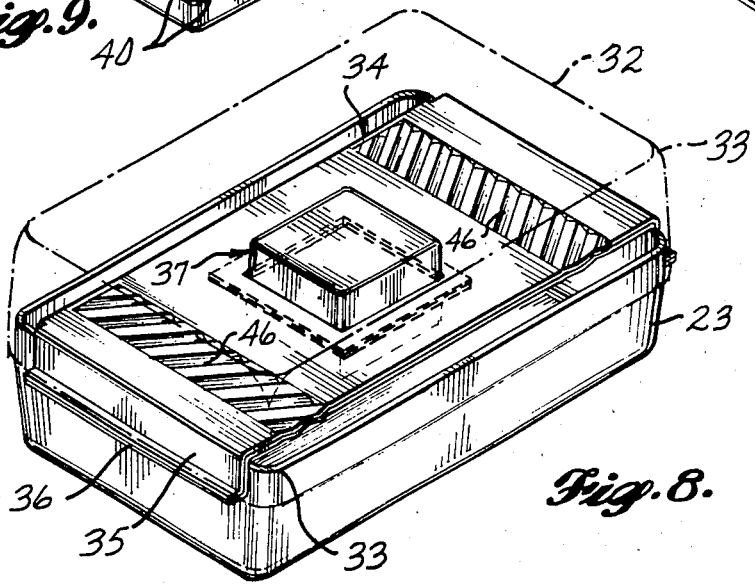
FIG. 8 is a somewhat diagrammatic, top perspective of another embodiment of a protective package in accordance with the present invention which also includes an outer rigid box and an article-suspending cradle.

Still another modification of the embodiment of FIGS. 8 through 11 is the provision of transversely extending strips 46 of oppositely directed, diagonal corrugations toward the opposite ends of the central portion of each cradle section, which promote both longitudinal and transverse flexing of the cradle. As best seen in FIG. 8, when the top cradle section has been folded over onto the bottom cradle section, each corrugation registers with a corrugation in the other cradle section.

In assembling the package shown in FIGS. 8 through 11, the fragile article is placed in the separate article container 37 and enclosed therein by folding over the lid section 39 onto the base section 38. The closed container then is placed in the aperture 45 through the bottom cradle section 42 with the support flanges 40 resting on the inner margin of the cradle adjacent to such aperture. Next the top cradle section 41 is folded over onto the bottom cradle section 42 with its aperture 45 being fitted over the lid section 39 of the separate article container as the folding operation is completed. The cradle sections can be secured together if, for example, a hermetic seal is desired around the fragile article. The legs 35 of the assembled cradle then are fitted over the opposite ends of the box base 23 and the lid 32 is telescoped downward over them until it engages the double thickness stop flanges 36 projecting outward from the legs.

Figures 12, 13, 14:
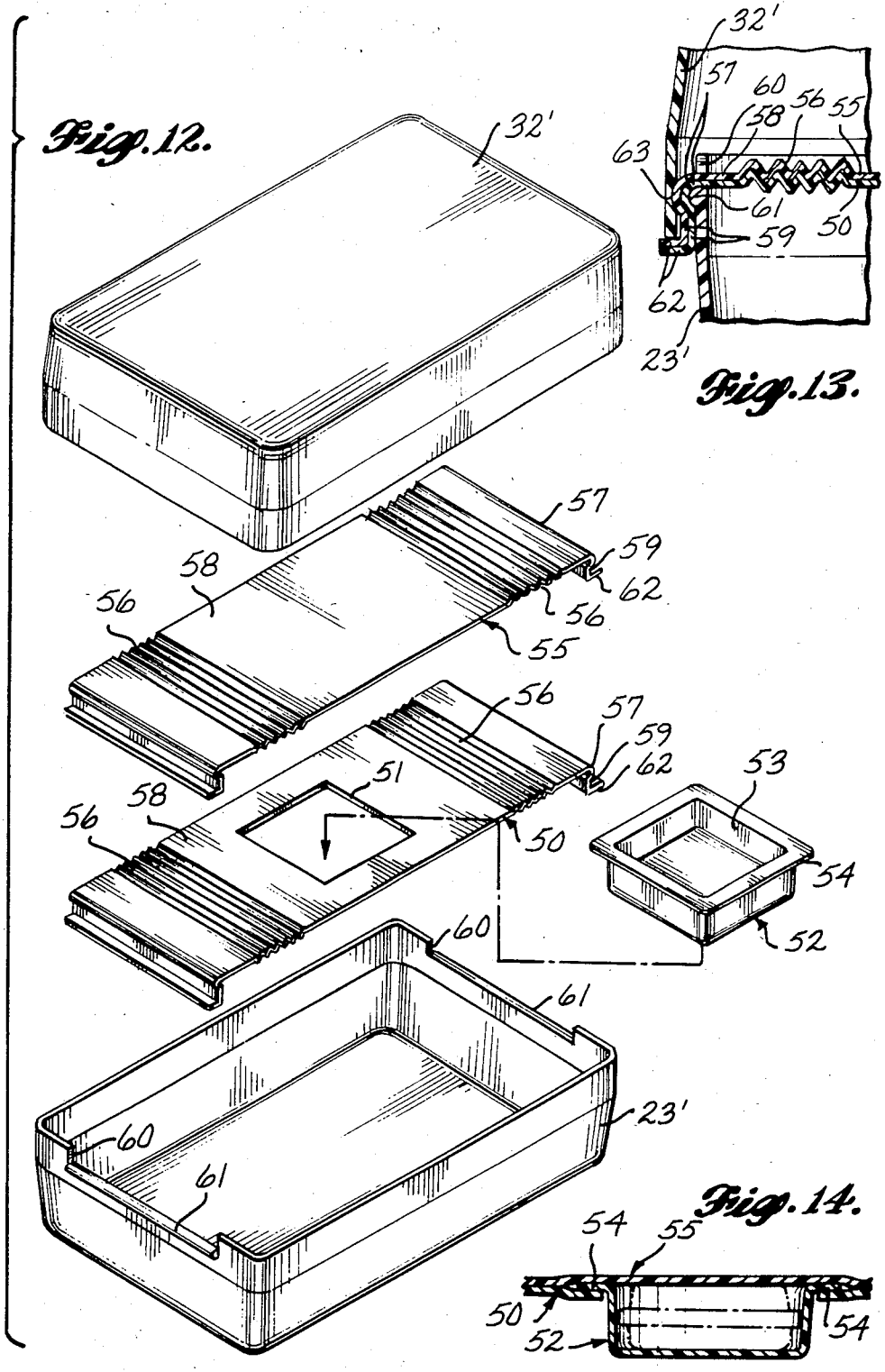
FIG. 12 is a somewhat diagrammatic, exploded, top perspective of another embodiment of a protective package in accordance with the present invention.
FIG. 13 is an enlarged, fragmentary, vertical section of an end portion of such package showing the parts in assembled relationship.
FIG. 14 is an enlarged, longitudinal, vertical section of the central portion of such package showing the article-enclosing portion of the package.

In the form of the present invention shown in FIGS. 12 through 14, as in the form shown in FIGS. 8 through 11, the article-supporting cradle includes substantially complementary top and bottom sections. Only the bottom section 50, however, has a central opening in the form of an aperture 51 for receiving the open topped article container 52 which has a central cavity 53 for receiving the fragile article to be packaged. Integral support flanges 54 project outward from the cavity-forming portion of the container and rest on the upper surface of the bottom cradle section 50 adjacent to its aperture 51 when the container is fitted in the aperture.

The top cradle section 55 is formed separately rather than being hinged to the bottom section. Its central portion is substantially planar so as to cover the open top of the separate article container 52, as best seen in FIG. 14. The strips 56 of shock-absorbing corrugations in each cradle section, which, as in the embodiment of FIGS. 8 through 11, extend widthwise of the cradle toward its opposite ends, include only laterally extending corrugations. As best seen in FIG. 13, the corrugations of each cradle section register with the corrugations of the other section.

As also shown in FIG. 13, rounded, almost return bent, junctions 57 are formed between each end of a cradle central portion 58 and the corresponding leg 59 projecting downward therefrom. Each junction forms a concave recess at its inner side and a corresponding convex projection at its outer side. As the top cradle section is forced downward over the bottom cradle section, the two sections are secured together in snap fit engagement with the recesses at the inner sides of the junctions of the top cradle section receiving the projections at the outer sides of the junctions of the bottom cradle section.

After assembly of the composite cradle, its double thickness legs are fitted over the ends of the base 23' of the modified outer rigid box shown in FIG. 12. Wide notches 60 are formed in the upper portions of the opposite ends of the box base into which the opposite end portions of the cradle are fitted as the legs are forced over the ends of the box base. As best seen in FIG. 13, a convex projection 61 extending outward directly below each notch 60 is received in the concave recess at the inner side of the junction 57 of the bottom cradle section, serving as a detent deterring withdrawal of the cradle from the box base. Similarly, as the modified box lid 32' is telescoped over the legs to the position indicated in FIG. 13 with the lower edges of its opposite ends engaging the stop flanges 62 projecting outward from the cradle legs 59, a concave recess 63 formed in the inner side of each end of the lid is snapped over the convex projection formed at the outer side of the upper cradle section to serve as a detent deterring separating movement of the box lid from the base.

Figure 17:
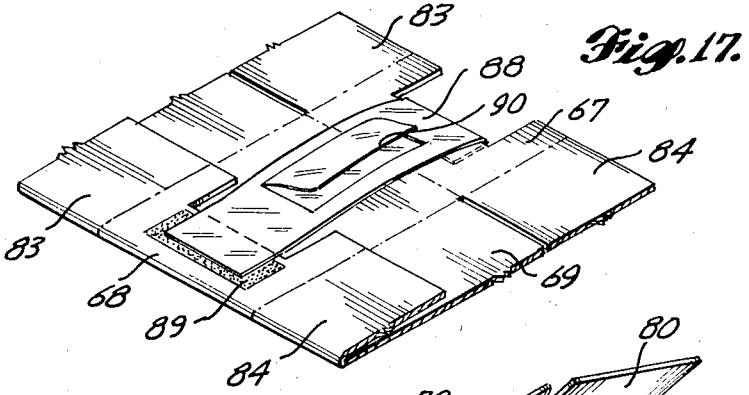
FIG. 17 is a somewhat diagrammatic, top perspective of the box blank of FIG. 15 after attachment of such an article-supporting cradle illustrating how the composite package can be folded flat for shipment or storage.
Figure 16:
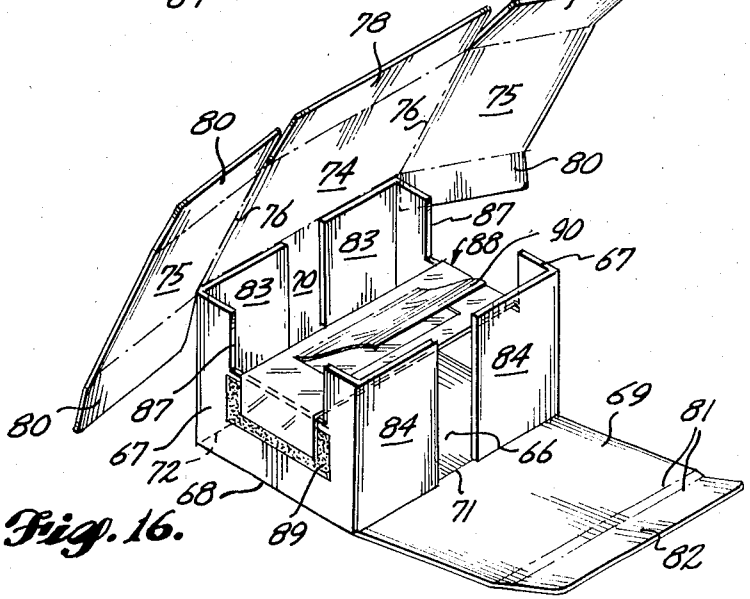
FIG. 16 is a fragmentary, top perspective of a protective package in accordance with the present invention including an article-supporting cradle and using the box blank of FIG. 15.
Figure 15:
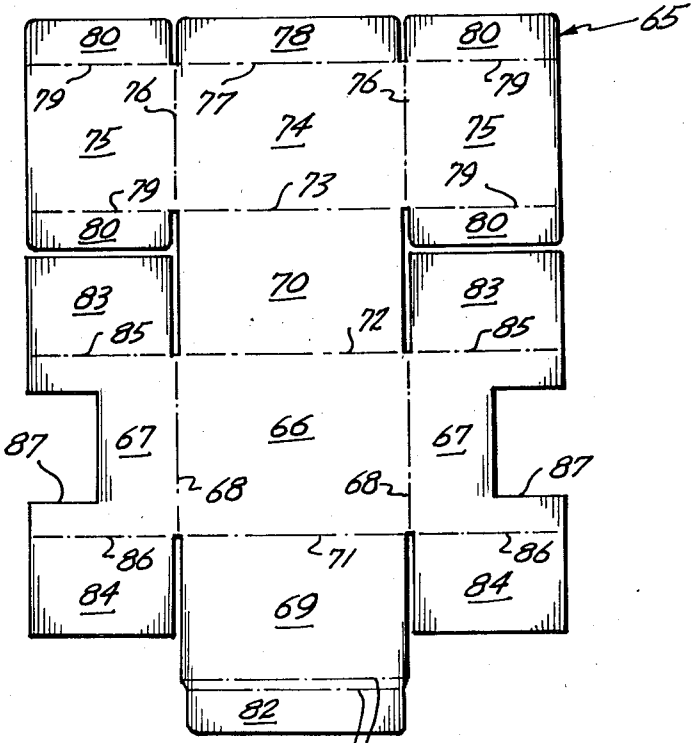
FIG. 15 is a top plan of a foldable box blank usable in the present invention.

For the form of the present invention shown in FIGS. 15 through 17, the outer rigid box is of one piece construction, preferably being formed from the precut, foldable box blank 65 shown in FIG. 15, which can be paperboard or corrugated cardboard. The dot-dash lines indicate fold lines or creases made during the manufacturing of the blank.

The box blank 65 includes a rectangular bottom section 66 joined to inner side or end sections 67 by spaced, parallel fold lines 68. Such bottom section also is joined to the front and back sections 69 and 70, respectively, by spaced, parallel fold lines 71 and 72, respectively, extending perpendicular to the fold lines 68.

A fold line 73 joins the box top section 74 to the edge of the back section 70 remote from its fold line 72. Outer side or end sections 75 are joined to the top section 74 by fold lines 76 which extend perpendicular to the fold line 73 from generally its opposite ends. A fold line 77 at the edge of the box top section 74 remote from its fold line 73 joins a short, top tab 78 to such top section; and fold lines 79 aligned with lines 73 and 77 join two short side tabs 80 to each outer side section 75 at its opposite sides.

At the other end of the box, a double fold line 81 joins a front tab 82 to the edge of the box front 69 remote from its fold line 71.

The construction of the box blank is completed by back flaps 83 and front flaps 84 joined to the opposite sides, respectively, of the side sections 67 by the fold lines 85 aligned with line 72 and the fold lines 86 aligned with line 71.

The box blank is folded to the condition shown in FIG. 16 by first bending the inner side sections 67 along the fold lines 68 so as to project perpendicularly upward from the box bottom 66. The back flaps 83 and the front flaps 84 are bent perpendicularly inward so as to extend generally along the fold lines 72 and 71, respectively. Then the box back section 70 is bent upward along the fold line 72 so as to extend vertically behind the flaps 83. The front of the box can be completed from the position shown in FIG. 16 by folding the box front 69 upward and return bending the front tab 82 along the double fold line 81 so as to tuck it in along the inner sides of the front flaps 84.

In this condition of the box, a cradle of any of the types previously described can be inserted into the upward opening notches 87 formed in the upper end portions of the inner box sides 67. Alternatively, as shown in FIG. 16, a tubular cradle 88 of flexible material can be stretched across the ends of the box, and the opposite end portions of the flexible cradle can be secured to the outer sides of the box ends, such as by patches 89 of pressure-sensitive adhesive applied to the box. For example, the flexible cradle 88 can be of thin plastic or paper material and can be provided with a flap 90 allowing the fragile article to be inserted into the tube of the cradle whereupon the flap can be closed. As shown in FIG. 17, an advantage of using the cradle of flexible material in this form of the invention is that after the box blank has been formed, the cradle end portions can be secured to the box inner ends and the blank still can be folded substantially flat for shipment or storage.

Returning to FIG. 16, for closing the top of the box, the top tab 78 is bent substantially perpendicular to the box top section 74 and, as such top section is folded downward, is tucked into the front of the box adjacent to the front tab 82. The side tabs 80 are swung perpendicular to the outer side sections 75 along the fold lines 79 and then are tucked, respectively, into the crease between the front flaps 84 and the box front 69, and the crease between the back flaps 83 and the box back 70, as the outer sides or ends 75 are swung down along the fold lines 76.

Figures 18, 19, 20:
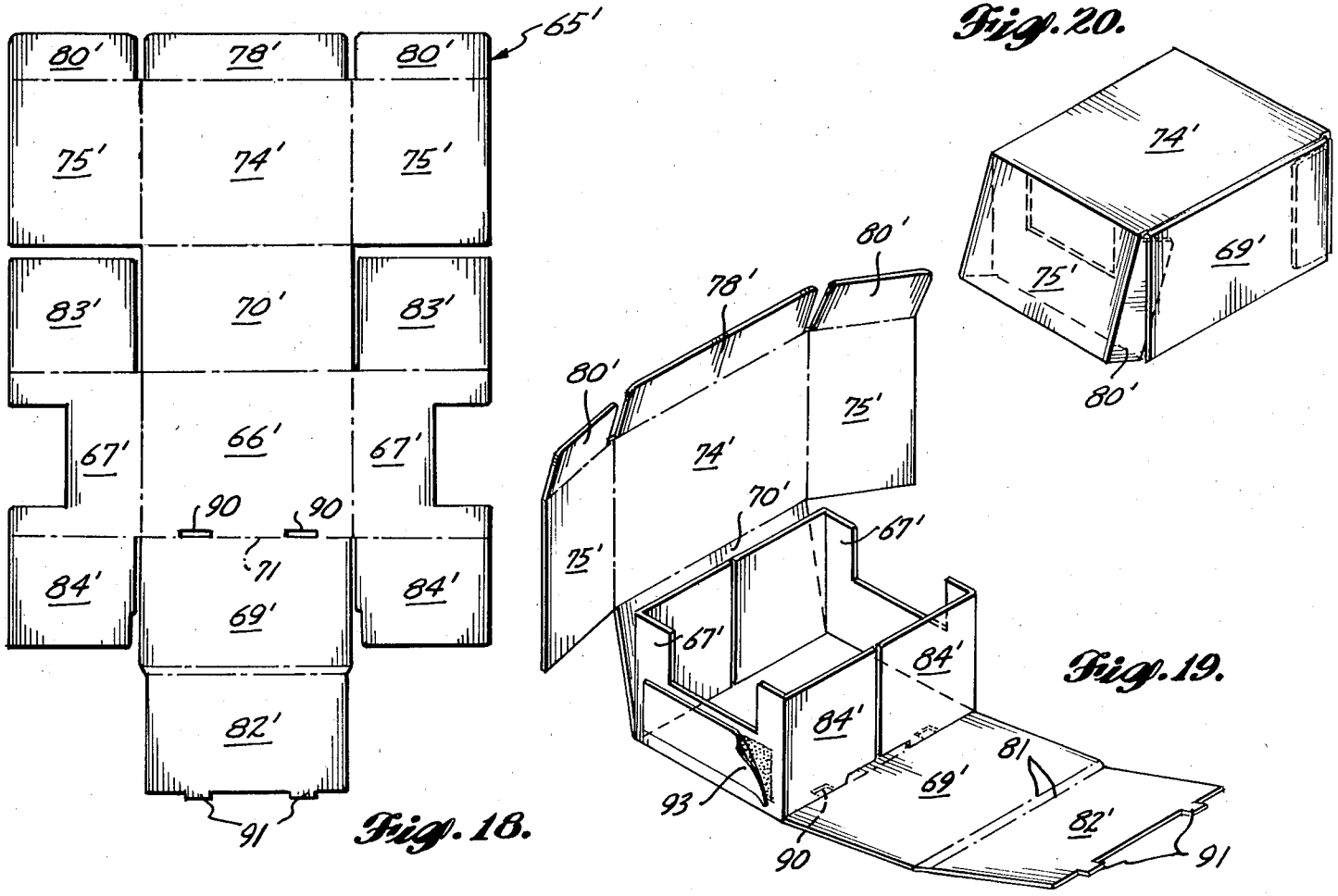
FIG. 18 is a top plan of a modified form of foldable box blank usable in the present invention.
FIG. 19 is a top perspective of the box blank of FIG. 18 in partially folded condition.
FIG. 20 is a top perspective of the box blank of FIG. 23 in almost completely folded condition.

The construction of the modified foldable box blank 65′ shown in FIG. 18 is very similar to the construction of the box blank shown in FIG. 15, with the exception that side tabs 80′ are formed only along the edges of the box outer side sections 75′ remote from the back flaps 83′. In addition, notches 90 are formed along the fold line 71 joining the box bottom 66′ to the box front 69′; and the front tab 82′ is much longer than the tab 82 shown in FIG. 15. The modified front tab 82′ has short projections 91 along its bottom edge directly opposite the bottom notches 90 so that, after the box has been folded to the condition shown in FIG. 19, the box front 69′ can be folded upward along the front flaps 84′ and the front tab 82′ can be return bent along the double fold line 81 with the projections 91 being fitted in the notches 90 to provide a more sturdy box construction.

As also seen in FIG. 19, the box ends 67′ can be provided with large patches of pressure-sensitive adhesive normally covered by the nonadhesive strip 93 which can be peeled from the box ends as indicated in FIG. 19. A cradle of flexible or substantially rigid material then can be inserted and will be held in position by the pressure-sensitive adhesive. In addition, as the box is folded to the condition shown in FIG. 20, the outer end sections 75′ of the box will be secured to the inner box end sections 67′ by the adhesive.

Figure 21:
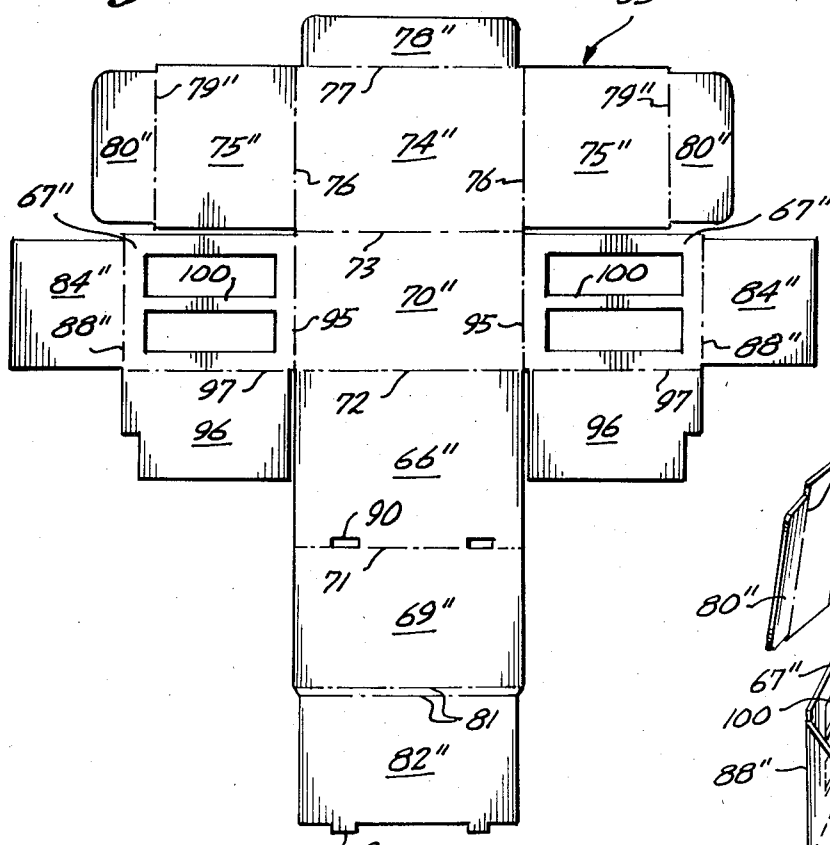
FIG. 21 is a top plan of another modified form of foldable box in the present invention.
Figure 22:
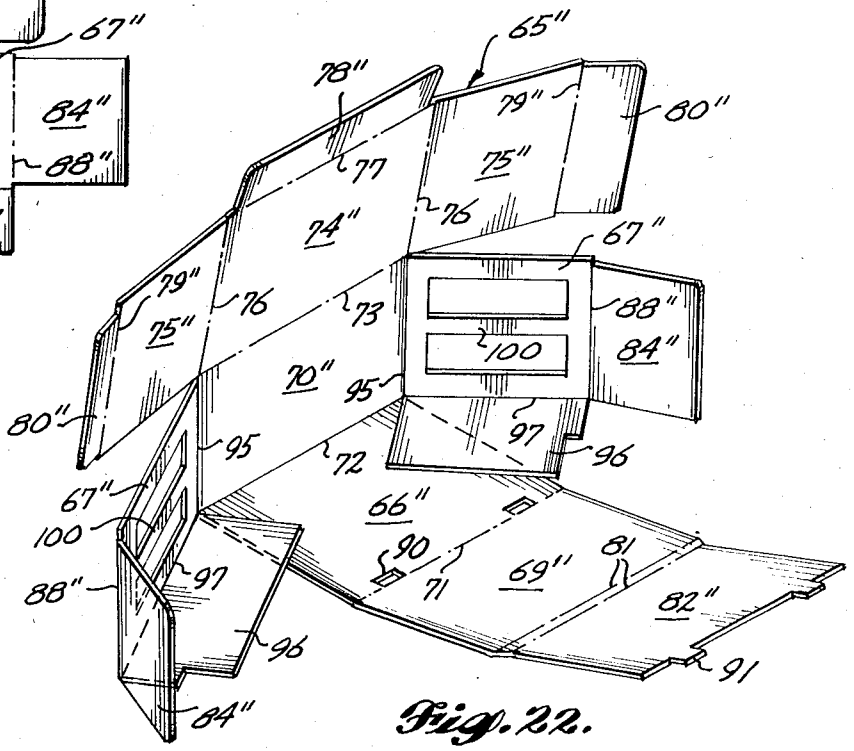
FIG. 22 is a top perspective showing the box blank of FIG. 21 in partially folded condition.

Another type of foldable box blank that can be used in the present invention is shown in FIGS. 21 through 25. With reference to FIGS. 21 and 22, the central portion of the box blank 65″ is the same as for the form shown in FIG. 18 including the top tab 78″, top 74″, back 70″, bottom 66″, front 69″ and front tab 82″ joined by spaced, parallel fold lines 77, 73, 72, 71 and 81 similar to the construction of the previously described embodiment. The modified blank includes outer side or end sections 75″ joined to the top section 74″ by fold lines 76, but the side tabs 80″ project from the opposite ends of the outer side sections 75″, such side tabs being joined to the outer side sections by the fold lines 79″ which are parallel to lines 76.

Also, the box inner side or end sections 67″ are hinged to the box back 70″ by fold lines 95 extending between the ends of lines 72 and 73 rather than being hinged to the box bottom as in the previously described embodiments. Bottom flaps 96 are joined to the bottom edges of the side sections 67″ by fold lines 97 aligned with the fold line 72 between the box bottom and back. Front flaps 84″ are joined to the ends of the box side sections 67″ remote from the box back by the fold lines 88″.

Figures 23, 24, 25, 26, 27, 28:
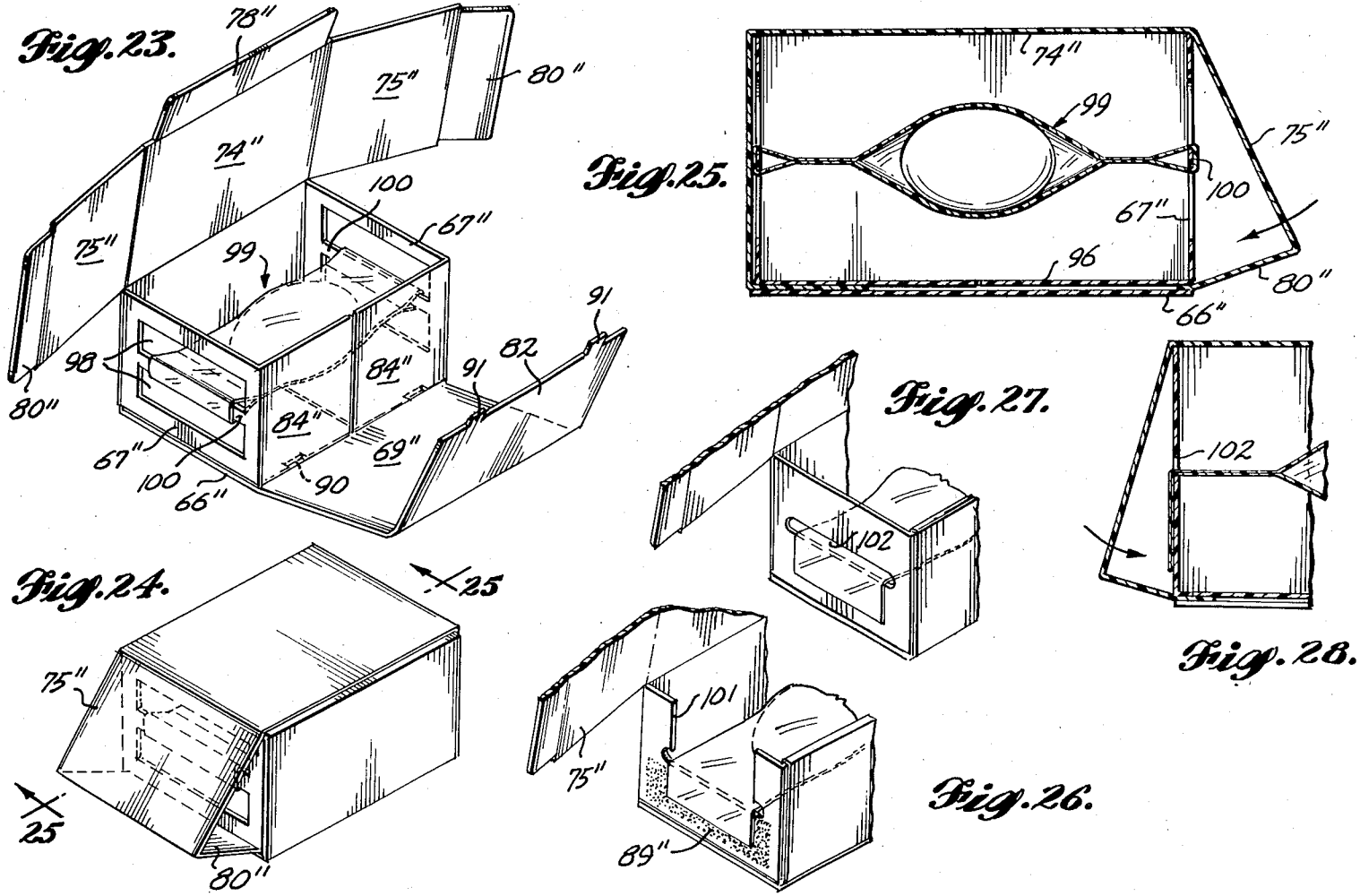
FIG. 23 is a top perspective of a protective package in accordance with the present invention showing the box blank of FIG. 21 in further folded condition with an article-supporting cradle secured to the ends of the box blank.
FIG. 24 is a top perspective showing the cradle and the box blank in still further folded condition.
FIG. 25 is a vertical section taken along line 25—25 of FIG. 24.
FIGS. 26 and 27 are corresponding fragmentary, top perspectives of protective packages in accordance with the present invention using modified forms of foldable box blanks that can be substituted for the blank of FIG. 21.
FIG. 28 is a somewhat diagrammatic, fragmentary, longitudinal section of the package of FIG. 26 in almost completely assembled relationship.

In assembling the modified box blank of FIGS. 21 through 25, it can be folded or bent along the parallel fold lines 77, 73, 72, 71 and 81 as indicated in FIG. 22, and the side sections 67″ can be bent inward along the fold lines 95 after the bottom tabs 96 have been folded upward along the fold lines 97. As best seen in FIG. 23, the front flaps 84″ can be folded inward to extend along the front edge of the box bottom, after which the box front 69″ can be folded upward and the front tab 82 can be bent over the front flap 84″ and have its projections 91 fitted in the notches 90 in the box bottom.

As best seen in FIG. 23, the box inner end sections 67″ can have vertically spaced apertures or openings 98 so that a tubular cradle 99 of flexible material into which the fragile article to be packaged has been inserted can have each of its opposite end portions fitted through one end opening, wrapped around the rib 100 formed between the openings and then be secured to itself such as by gluing or pressure-sensitive adhesive or heat-sealing or welding. The box can be closed and 25 by tucking the top flap 78″ into the box as the top 74″ is folded down, whereupon the outer side sections 75″ can be folded over the box ends and the side tabs 80″ can be fitted in the creases between the box bottom 66″ and the bottom flaps 96.

Rather than forming vertically spaced openings in the box inner end sections 67″, such sections can have an upward opening notch 101, as indicated in FIG. 26, with patches 89″ of pressure-sensitive adhesive beneath the slots for securing the opposite ends of the cradle and the box outer end sections 75″. Another possibility is to provide a single slot 102 in each box inner end section, as shown in FIGS. 27 and 28, through which an end portion of the tubular cradle of flexible material can be threaded and then be secured to the outer side of the box end below the slot.

Figures 29, 30, 31, 32, 33:
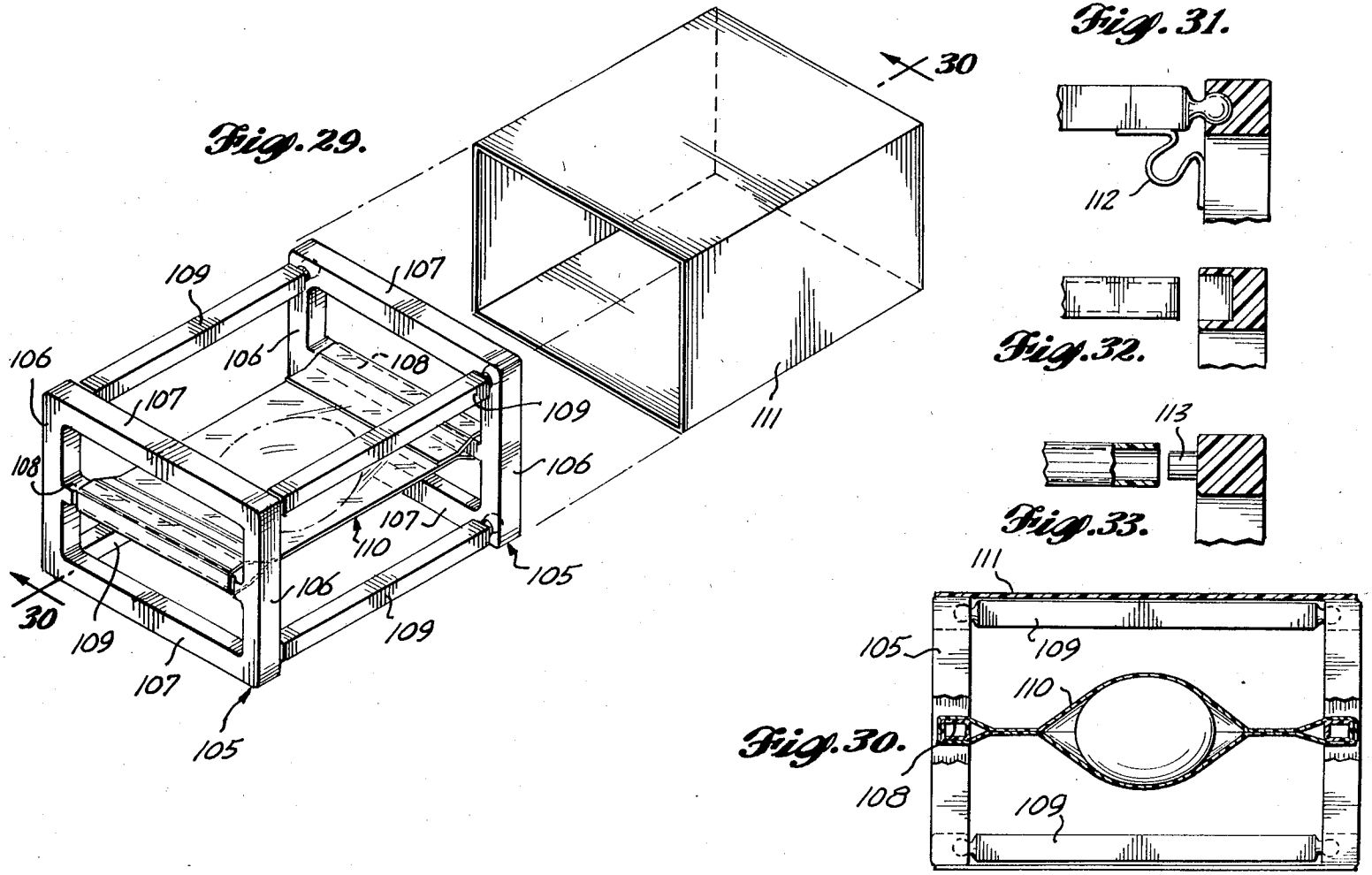
FIG. 29 is a somewhat diagrammatic, partially exploded, top perspective of another embodiment of a protective package in accordance with the present invention having an open framework for an article-supporting cradle.
FIG. 30 is a longitudinal vertical section taken along line 30—30 of FIG. 29 but with all of the package components assembled.
FIGS. 31, 32 and 33 are corresponding, enlarged, fragmentary, side elevations of modified frameworks usable in generally the form of the invention shown in FIGS. 29 and 30, with parts broken away.

The modified form of the present invention shown in FIGS. 29 and 30 uses a rigid framework instead of a rigid box. The framework includes rectangular end pieces 105 each having upright corner post portions 106 joined by top and bottom horizontal cross members 107 and a central cross member 108. The end pieces are maintained in spaced relationship by longitudinally extending horizontal rails or stringers 109 each having its opposite ends connected to the inner sides of the corner portions of the end pieces. In the form shown in FIGS. 29 and 30, the ends of the rails or stringers are rounded and fit snugly in rounded blind bores in the inner corner portions of the end pieces.

The fragile article to be packaged can be placed in a tubular cradle 110 of flexible material and the end portions of the cradle can be wrapped around the central cross members 108 and secured to the central portion of the cradle such as by heat-sealing. To asssure that the cradle is tensioned, it can be formed of heat-shrinkable material and be heated, such as by hot air, after having its opposite ends secured. Nevertheless, the cradle can be formed of other types of material, including paper. A separate rectangular sleeve 111 can be provided to slip over the assembled framework package.

Optional connections of the rails or stringers to the end pieces are shown in FIGS. 31, 32 and 33. In the connection of FIG. 31, a flexible, loose hinge strip 112 has its opposite end portions secured, respectively, to the stringer and to an end piece. By attaching all of the rails to the end pieces in this manner, the assembly of the framework is easier. In addition, the hinge is of a length permitting the rail ends to be withdrawn from the end pieces so that the framework can be swung to a more flat condition for shipment.

In the connection shown in FIG. 32, the ends of the rails or stringers simply fit in blind bores in the inner corners of the end pieces; whereas in the connection shown in FIG. 33, the rails or stringers are tubular and the end pieces have inwardly directed projections 113 at their corners fittable in the bores of the stringers.

I claim:

1. A protective package for a fragile article comprising a substantially rigid outer box having an open-topped base with opposite upright ends and upright sides extending between said ends, and a separate, one-piece, shock-absorbing cradle of thin, substantially rigid plastic sheet material having elongated top and bottom sections of the same size and shape integrally hinged together along corresponding longitudinal sides and bendable toward each other into a folded condition in face-to-face contact, said cradle sections in folded condition forming between them a closed cavity for the article which cavity is located centrally between the opposite ends of said cradle sections, said cradle sections having complemental interfitting projections and recesses including respective projections and recesses located at opposite sides of said cavity for maintaining said cradle sections in folded condition, the opposite end portions of said cradle extending downward along the outer surfaces of the opposite upright ends of said box base with the central article-enclosing portion of said cradle disposed inside said box and supporting the article out of contact with the walls of said box, the opposite longitudinal sides of said cradle being in unconnected relationship relative to said sides of said box so that said cradle is supported only at its opposite end portions and is free to flex up and down in the area of said cavity relative to said box, said box including an open-bottomed lid having opposite upright ends fitted over the downward-extending opposite end portions of said cradle so that said end portions of both of said cradle sections are fitted between said box base and lid with said cradle top section adjacent to said box lid and said cradle bottom section adjacent to said box base, and including means for securing the opposite end portions of said cradle bottom section to the opposite ends of said box base and means for securing said opposite end portions of said cradle top section to said opposite ends of said box lid for maintaining said box base, said cradle and said lid in connected relationship with the article enclosed inside said cradle and protected against breakage by shock-absorbing flexing of said cradle in said box.

2. The package defined in claim 1, in which the cradle top and bottom sections each have integral shock-absorbing corrugations located at opposite sides of the article-enclosing cavity but between the downward-extending opposite end portions of the cradle, the corrugations of each cradle section being registered with the corrugations of the other section.

* * * * *